US012774572B2

(12) United States Patent
Huo et al.

(10) Patent No.: US 12,774,572 B2
(45) Date of Patent: Oct. 27, 2026

(54) SNOW THROWER

(71) Applicant: Greenworks (Jiangsu) Co., Ltd, Changzhou (CN)

(72) Inventors: Xiaohui Huo, Changzhou (CN); Yu Wang, Changzhou (CN); Shuhua Li, Changzhou (CN); Hongde Yuan, Changzhou (CN)

(73) Assignee: Greenworks (Jiangsu) Co., Ltd, Changzhou (CN)

( * ) Notice: Subject to any disclaimer, the term of this patent is extended or adjusted under 35 U.S.C. 154(b) by 269 days.

(21) Appl. No.: 18/675,143

(22) Filed: May 28, 2024

(65) Prior Publication Data

US 2024/0309597 A1 Sep. 19, 2024

Related U.S. Application Data

(63) Continuation of application No. PCT/CN2022/134557, filed on Nov. 28, 2022.

(30) Foreign Application Priority Data

Nov. 29, 2021 (CN) ..... 202122965595.2
Dec. 31, 2021 (CN) ..... 202123450667.6

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/045; E01H 5/098; B60K 17/344; F16H 37/043

(Continued)

(56) References Cited

U.S. PATENT DOCUMENTS 5,000,302 A * 3/1991 Takeshita ..... B60W 10/10 192/17 R
7,140,268 B2 * 11/2006 Leposky ..... B60K 17/344 74/420

(Continued)

FOREIGN PATENT DOCUMENTS

CN 104285009 A 1/2015
CN 110857553 A 3/2020

(Continued)

OTHER PUBLICATIONS

Douglas Wright, Spur Gears, May 2005; https://www-mdp.eng.cam.ac.uk/web/library/enginfo/textbooks_dvd_only/DAN/gears/intro/intro.html (Year: 2005).*

(Continued)

*Primary Examiner* — Jamie L McGowan

(57) ABSTRACT

A snow thrower includes a walking mechanism, a snow remove assembly, a transmission part, an impeller, an auger, a snow breaking blade, and a driving module. The snow remove assembly includes a first shaft and a second shaft. The transmission part is arranged between the first shaft and the second shaft to enable the first shaft to be in transmission connection with the second shaft. The impeller is mounted on the first shaft. The auger is mounted on the second shaft and distributed at two sides of the first shaft. The snow breaking blade is mounted at a front end of the first shaft and includes at least two blade boards protruding from the first shaft at different protruding distances. The driving module is in transmission connection with the first shaft and the walking mechanism.

14 Claims, 13 Drawing Sheets

(58) Field of Classification Search
USPC ..... 74/420; 475/220
See application file for complete search history.

(56) References Cited

U.S. PATENT DOCUMENTS 7,487,697 B2 * 2/2009 Marla ..... F16H 1/203 74/420
8,844,172 B2 * 9/2014 Cmich ..... E01H 5/09 37/251
8,925,311 B1 * 1/2015 Bennett ..... B60K 17/10 60/484
9,873,410 B2 * 1/2018 Laarman ..... B60D 1/66
2003/0040395 A1 * 2/2003 Palazzolo ..... B60K 17/344 475/222
2004/0226766 A1 * 11/2004 Cook ..... F16H 57/027 180/233
2004/0235605 A1 * 11/2004 Cook ..... F16H 1/203 475/220
2011/0094129 A1 * 4/2011 Rowe ..... E01H 5/045 37/246
2017/0101756 A1 * 4/2017 Zhang ..... B60K 1/00
2019/0023072 A1 * 1/2019 Lubben ..... B62D 55/125
2019/0120374 A1 * 4/2019 Han ..... F16H 61/30
2024/0309597 A1 * 9/2024 Huo ..... E01H 5/098

FOREIGN PATENT DOCUMENTS

CN 111877244 A 11/2020
WO 2020/038448 A1 2/2020

OTHER PUBLICATIONS

Douglas Wright, Spur Gears (Year: 2005).*
Extended European Search Report of Counterpart European Patent Application No. 22897953.0 issued on Mar. 11, 2025.
International Search Report of PCT Patent Application No. PCT/CN2022/134557 issued on Feb. 22, 2023.

* cited by examiner

SNOW THROWER

CROSS REFERENCE TO RELATED APPLICATION

The present application is a continuation Application of PCT application No. PCT/CN2022/134557 filed on Nov. 28, 2022, which claims the benefit of CN202122965595.2 filed on Nov. 29, 2021, and CN202123450667.6 filed on Dec. 31, 2021. All the above are hereby incorporated by reference for all purposes.

TECHNICAL FIELD

The disclosure relates a technical filed of garden tools, specifically relates to a snow thrower.

BACKGROUND

The snow thrower is a main snow removal tool in winter, and a driving device of the snow thrower drives the snow blowing system to work. The snow throwers on the market today typically use belts, worm gears and worms to transfer power to the auger assembly. Belt transmission leads to a large transmission center distance, the structure is not compact, and the belt is prone to a problem of size error and inconsistency in a process of design, manufacture and assembly, which needs to be replaced and repaired after a long-term use and is very inconvenient. Worm gear transmission has high power loss and low duration life. The above problems will affect the performance of snow blowing and snow throwing.

Therefore, it is necessary to change a transmission mode of the snow thrower to improve the working efficiency of the snow thrower.

SUMMARY

The disclosure provides a snow thrower to improve problems that conventional snow throwers have low transmission efficiency and complex assembling structure.

The disclosure provides the snow thrower. The snow thrower includes a main body, a walking mechanism, a snow remove assembly, and a driving module.

The walking mechanism is connected with the main body and drive the snow thrower to move.

The snow remove assembly is mounted on a front end of the main body and includes a first shaft, a second shaft, a transmission part, an impeller and an auger.

An axis of the first shaft is arranged along a first direction.

An axis of the second shaft is arranged along a second direction, and the second direction is perpendicular to the first direction or arranged at an angle with the first direction.

The transmission part is arranged between the first shaft and the second shaft to enable the first shaft to be connected with the second shaft for transmission.

The impeller is mounted on the first shaft.

The auger is mounted on the second shaft and distributed at two sides of the first shaft.

The driving module is connected to the first shaft and the walking mechanism for transmission.

In an embodiment of the disclosure, the transmission part includes a bevel gear and a cylindrical gear, and the bevel gear includes a first bevel gear and a second bevel gear, the cylindrical gear includes a first gear, a second gear, a third gear and a fourth gear, the first gear and the second bevel gear are coaxially arranged, the second gear and the third gear are coaxially arranged, the first bevel gear is meshed with the second bevel gear, the first gear is meshed with the second gear, the third gear is meshed with the fourth gear, a first rotation shaft is detachably connected with the first bevel gear, and a second rotation shaft is detachably connected with the fourth gear.

In an embodiment of the disclosure, the driving module includes a first motor, a first end of the first shaft is connected with the first motor through a first reduction assembly, the first reduction assembly includes a planetary transmission device, and power of the first motor is transmitted to the first shaft through the first reduction assembly.

In an embodiment of the disclosure, the planetary transmission device includes a first reduction housing, an inner gear ring, a first planet carrier, a first planetary gear, a second planet carrier, a second planetary gear and a sun gear, the inner gear ring is installed in the first reduction housing, the first planetary gear is mounted on the first planet carrier and meshes with the inner gear ring, the sun gear is arranged at a center of the first planet carrier, the second planetary gear is mounted on the second planetary carrier and meshes with the inner gear ring and the sun gear respectively, and the second planetary carrier is connected with the first rotating shaft.

In an embodiment of the disclosure, an output shaft of the first motor is provided with external teeth, and an output end of the first motor is meshed with the first planetary gear.

In an embodiment of the disclosure, a transmission stage of the first reduction assembly is from 1 to 4, and a transmission stage of a second reduction assembly is from 1 to 4.

In an embodiment of the disclosure, the driving module further includes a second motor to drive the walking mechanism, and a ratio of a rated output power of the second motor to a rated output power of the first motor is from 0.02 to 0.5.

In an embodiment of the disclosure, the walking mechanism includes a wheel shaft and walking wheels arranged at two ends of the wheel shaft, the second motor drives the wheel shaft to rotate through a third reduction assembly.

An output shaft of the second motor and the wheel shaft are arranged in parallel, and a center distance between the output shaft of the second motor and the wheel shaft is greater than or equal to 40 mm and less than or equal to 120 mm.

In an embodiment of the disclosure, the walking mechanism includes a walking wheel, and a distance from a rotation center of the walking wheel to a ground is from 100 mm to 350 mm.

In an embodiment of the disclosure, a distance from the rotation center of the walking wheel to the second rotating shaft is greater than or equal to 280 mm and less than or equal to 850 mm.

In an embodiment of the disclosure, the snow thrower further including a snow breaking blade, and the snow breaking blade is mounted at a front end of the first shaft.

In an embodiment of the disclosure, the snow breaking blade comprises an blade board, the blade board is arranged to protrude along a radial direction of the first shaft, the blade board is connected with a sleeve barrel, the sleeve barrel is plug-in fitted with the front end of the first shaft, the sleeve barrel and the first shaft are provided pin holes corresponding to each other, and the pin hole is provided with a safety pin.

In an embodiment of the disclosure, the blade board includes a connection part and an auger part, the connection part is fixedly connected with the first shaft, the connection part is arranged cantilevered radially along the first shaft, the auger part is located at an overhanging end of the connection part, the auger part is arc-shaped, the auger part is arranged in a spiral shape along an axis direction of the first shaft, so as to enable the blade board to be capable of pushing snow in contact with blade board to a rear of the first shaft when the first shaft rotates.

In an embodiment of the disclosure, there are at least two blade boards, each blade board is arranged at intervals along a circumferential direction of the first shaft, and protruding distances of the at least two blade boards along the radial direction of the first shaft are different.

In an embodiment of the disclosure, an upper side and a rear side of the snow remove assembly are provided with a cover, the cover is fixedly connected with the main body, the snow breaking blade protrudes out of a front side of the cover, a rear end of the cover is provided with a impeller cavity, the impeller is located in the impeller cavity, a side wall of the impeller cavity is provided with a snow throwing port, an outside of the snow throwing port is connected with a snow throwing chute, and the snow throwing chute is rotably connected with the snow throwing port to adjust an snow throwing angle.

Beneficial effects of exemplary embodiments of the disclosure are that:

The snow thrower of the disclosure transmits the power of the first motor to the first shaft through the first reduction assembly, and then transmits the power of the first motor to the auger assembly through the second reduction assembly. A rotation of the auger is utilized to roll snow into the auger assembly, and the snow is thrown out of the impeller cavity with a rotation of the impeller. The snow thrower of the disclosure adopts a planetary transmission reduction device. Compared with a traditional belt transmission, the snow thrower has a more compact structure, takes up less space, and improves transmission efficiency. A self-propelled system and snow blowing system of the snow thrower are more compact in structure, which has a better snow throwing performance, longer battery life and saves more power.

The first shaft of the disclosure is directly driven by the drive module, and power of the first shaft is transmitted to the second shaft through the transmission part, so that one driving source drives two shafts to rotate simultaneously, and a device structure is simplified.

The snow breaking blade is set in a twisted anchor-like structure, which can break up accumulated snow during a rotation of the first rotating shaft, and a twisted shape can transport the broken snow into the cover, which prevents the snow from accumulating in front of the snow thrower, and ensures that the snow breaking blade can move forward smoothly.

The disclosure is provided with two blade boards, one large and one small. The larger blade board can cut the larger snow block of accumulated snow, and the smaller blade board can further break the snow block, so as to facilitate a subsequent collection and throwing.

During a rotation of the second shaft, the accumulated snow can be gathered towards a center of the second shaft since a first spiral blade and a second spiral blade rotate in opposite directions, so that the accumulated snow can be smoothly guided to the impeller.

A worm gear mechanism can not only realize a power transmission in a vertical direction, but also has an effect of reducer itself. Rotating speeds of the snow breaking blade and impeller during working needs to be higher than the rotating speed of the auger during working, and the worm gear mechanism of the disclosure realizes a reduction transmission of the first shaft to the second shaft.

DETAILED DESCRIPTION

The following describes the implementation of the disclosure through specific embodiments, and those skilled in the art can easily understand other advantages and effects of the disclosure from the content disclosed in this specification. The disclosure may also be implemented or applied through other different specific embodiments. Various details in this specification may also be modified or changed based on different viewpoints and applications without departing from the disclosure. It should be noted that, the following embodiments and the features in the embodiments can be combined with each other without conflict.

Figure 1:
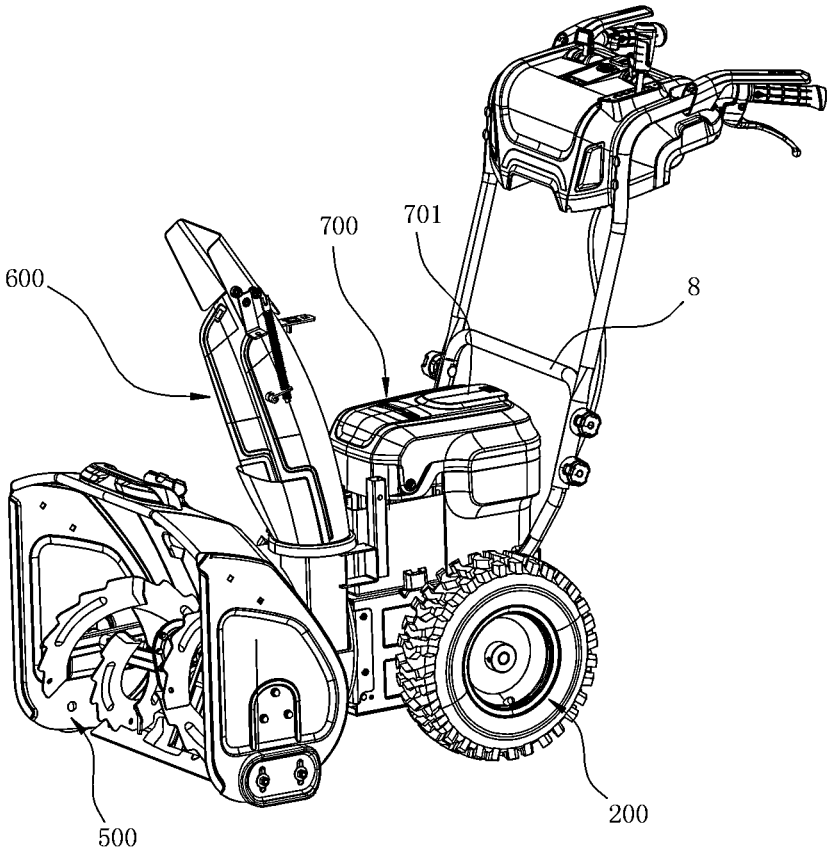
FIG. 1 is a schematic structural view of a snow thrower according to at least one embodiment of the disclosure.
Figure 2:
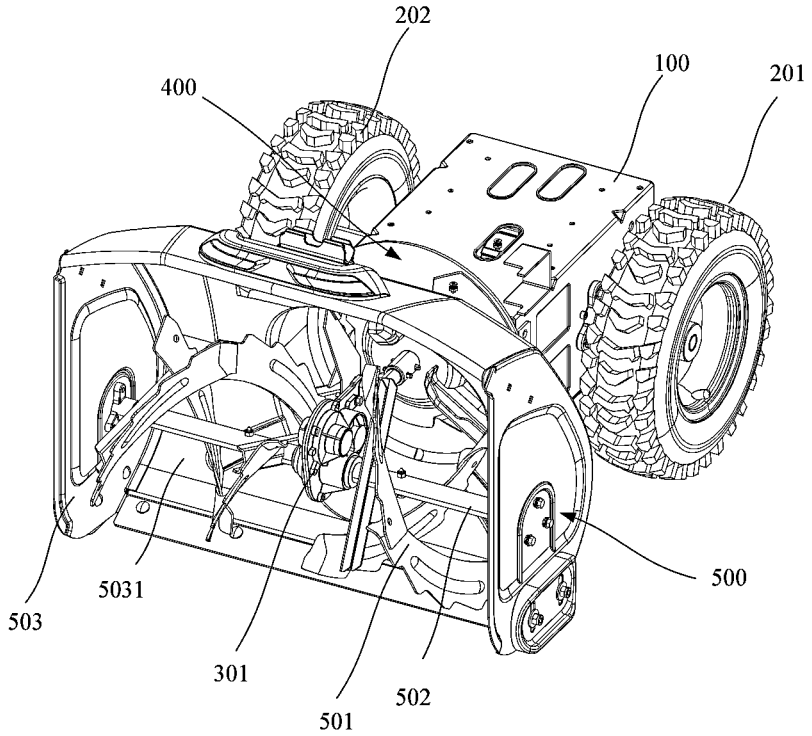
FIG. 2 is a schematic structural view of a snow thrower after removing a battery assembly according to at least one embodiment of the disclosure.
Figure 3:
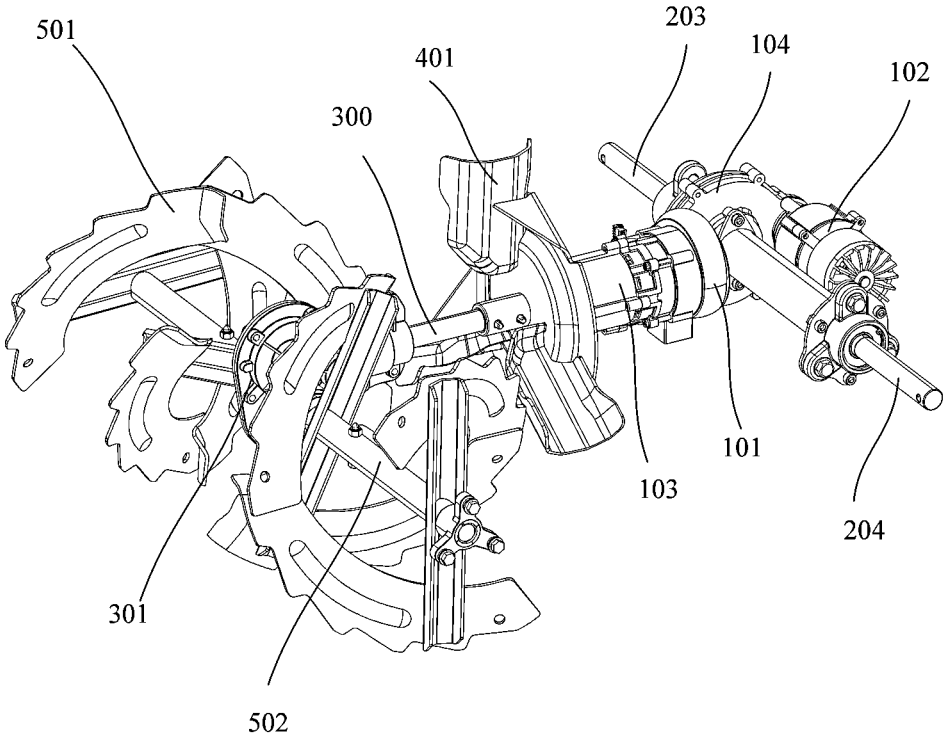
FIG. 3 is a schematic structural view of a snow thrower after removing a main body according to at least one embodiment of the disclosure.

Please refer to FIG. 1 through FIG. 17. The embodiment provides a snow thrower to improve problems that conventional snow throwers have complex assembly structure and low transmission efficiency. Please refer to FIG. 1 through FIG. 3. The snow thrower includes a main body 100, a first motor 101, a walking mechanism 200, a first shaft 300, an impeller assembly 400 and an auger assembly 500. The first motor 101 is used to drive the impeller assembly 400 and the auger assembly 500. In this embodiment, the first motor 101 is located inside the main body 100. The walking mechanism 200 is connected with the main body 100 and drives the snow thrower to move. A first end of the first shaft 300 is connected with the first motor 101 through the first reduction assembly 103, and a second end of the first shaft 300 is connected with an input end of the second reduction assembly 301 (which means a transmission part). The impeller assembly 400 includes an impeller 401. The impeller 401 is mounted on the first shaft 300 and rotates with the first shaft 300 synchronously. The auger assembly 500 includes an auger 501 and a second shaft 502. The auger 501 is fixed on the second shaft 502, and the second shaft 502 is connected with the first shaft 300 through the second reduction assembly 301. The driving module includes the first motor 101, and power of the first motor 101 is transmitted to the first shaft 300 through the first reduction assembly 103. The first shaft 300 drives the impeller 401 to rotate and drives the auger 501 to rotate through the second reduction assembly 301, and then accumulated snow is thrown out through the impeller assembly 400.

Figure 4:
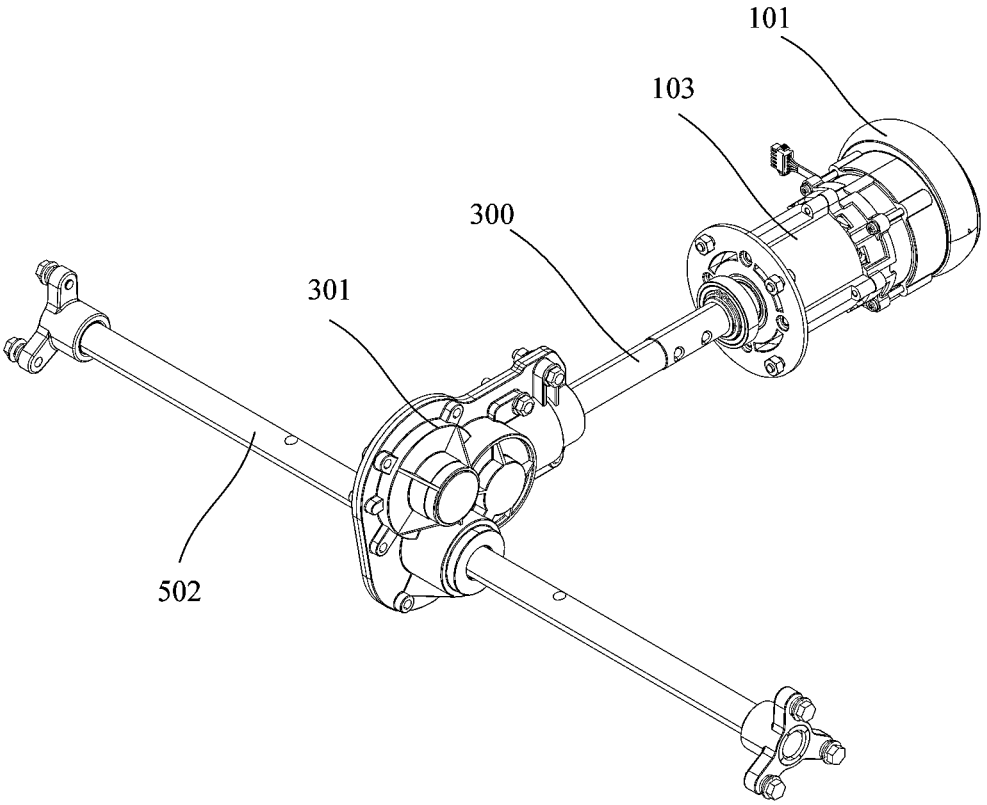
FIG. 4 is a schematic structural view of a transmission structure of a first motor of the snow thrower according to at least one embodiment of the disclosure.
Figure 5:
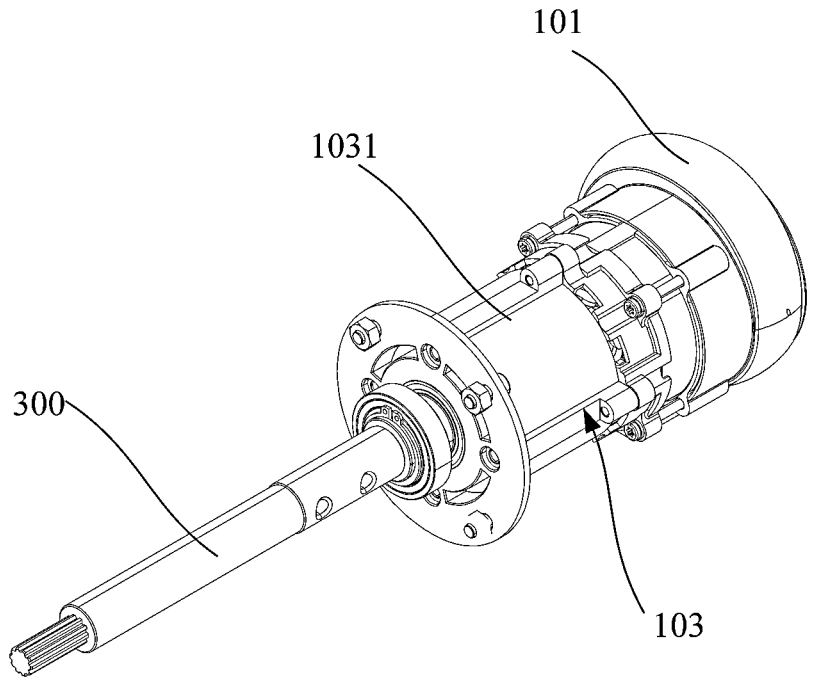
FIG. 5 is a schematic structural view of an assembly of a first motor, a first shaft and a first reduction assembly of the snow thrower according to at least one embodiment of the disclosure.
Figure 6:
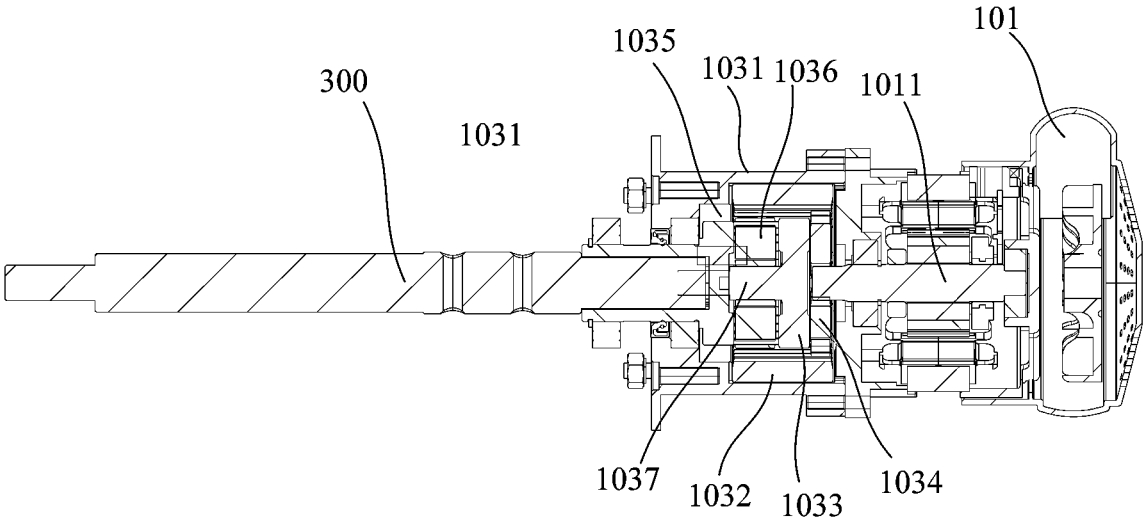
FIG. 6 is a cross-sectional view of FIG. 5.
Figure 7:
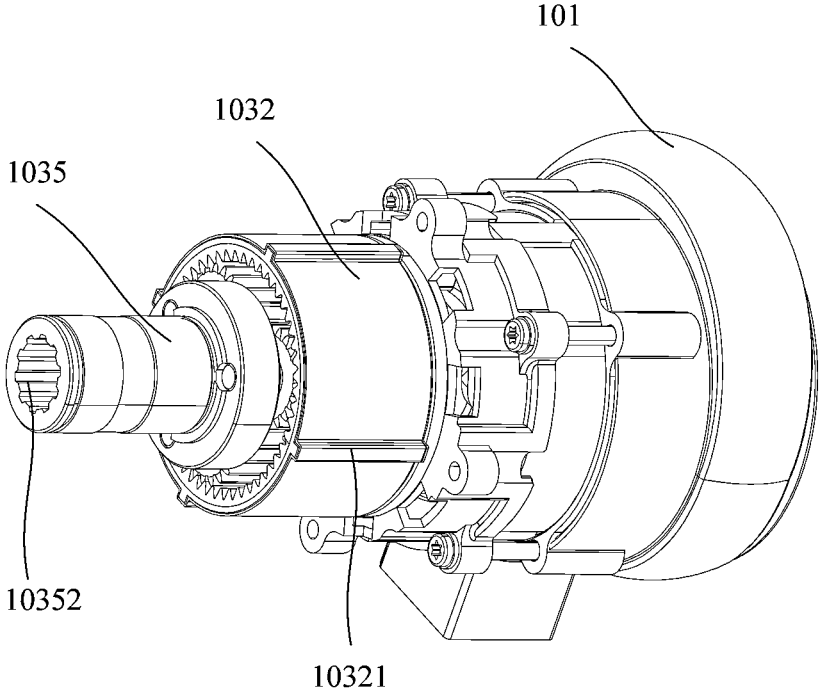
FIG. 7 is a schematic structural view of a first reduction assembly of the snow thrower after removing a housing according to at least one embodiment of the disclosure.
Figure 8:
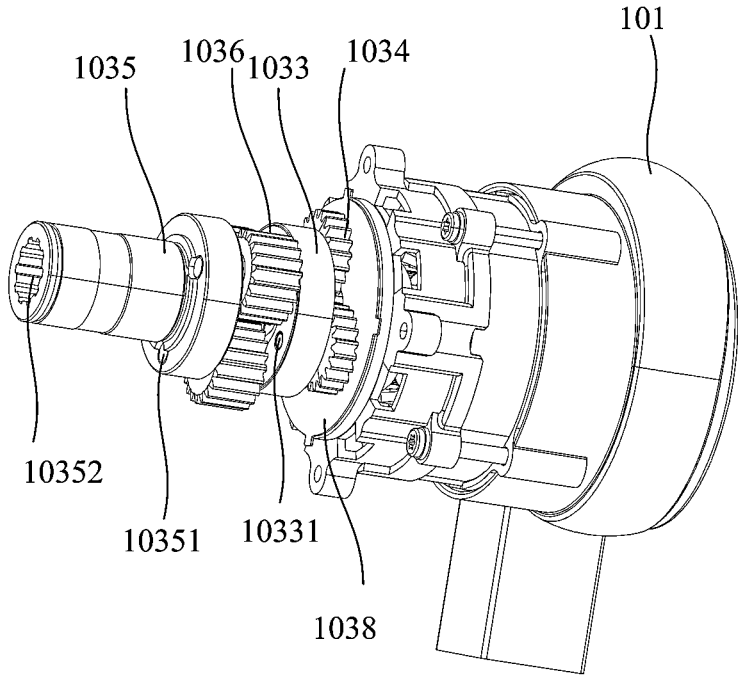
FIG. 8 is a schematic structural view of a first reduction assembly of a snow thrower after removing a housing and an inner gear ring according to at least one embodiment of the disclosure.
Figure 9:
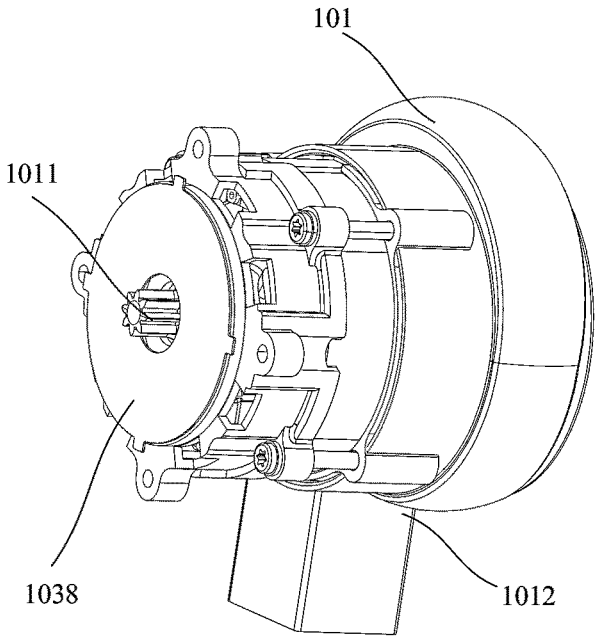
FIG. 9 is a schematic structural view of a first motor of a snow thrower according to at least one embodiment of the disclosure.

Please refer to FIG. 4. The first reduction assembly 103 is a planetary transmission device, and the transmission state of it is from 1 to 4, which means that the first reduction assembly 103 may be a first-stage transmission, a second-stage transmission, a third-stage transmission or a fourth-stage transmission. Of course, the first reduction assembly may also be with more transmission stages, which is not limited here. Considering an overall structure of the snow thrower and transmission efficiency, the transmission stage of the first reduction assembly 103 is from 1 to 4. In order to enable the snow thrower to be in a compact structure, in this embodiment, the first reduction assembly 103 selects a first-stage transmission. Adopting the planetary transmission device may enable an output shaft of the first motor 101 and the first shaft 300 to realize a concentric positioning, which means that a central axis of the output shaft of the first motor 101 and a central axis of the first shaft 300 may be located in a same straight line, so that the overall structure of the snow thrower is more compact.

Please refer to FIG. 2, FIG. 5 through FIG. 9. In an embodiment, the first reduction assembly 103 is located inside the main body 100 and is connected with the first motor 101. One end of the first motor 101 away from the first reduction assembly 103 is provided with a fan blade (not shown in the figure) and an air guiding cover 1012, so as to facilitate heat inside the main body of the motor to diffuse to an external space.

The first reduction assembly 103 includes a first reduction housing 1031, an inner gear ring 1032, a first planet carrier 1033, a first planetary gear 1034, a second planetary carrier 1035, a second planetary gear 1036 and a sun gear 1037. A first end of the first reduction housing 1031 is connected with the housing of the first motor 103, and a second end of the first reduction housing 1031 is fixed on the impeller assembly 400. Of course, in other embodiments, the second end of the first reduction housing 1031 may be fixed through other methods, such as fixed on the main body 100. The inner gear ring 1032 is installed in the first reduction housing 1031, and is stopped relative to the first reduction housing 1031. For example, a plurality of protrusions 10321 extending axially are arranged on an outer side wall of the inner gear ring 1032, grooves matching the protrusions 10321 are arranged in the first reduction housing 1031, and the inner gear ring 1032 is clamped in the first reduction housing 1031 through a matching of the protrusions 10321 and the grooves. The first planet carrier 1033 is arranged inside the inner gear ring 1032, and a plurality of first spindles 10331 for mounting the first planetary gear 1034 are arranged on one side of the first planet carrier 1033 facing the first motor 1031, for example, three first spindles 10331. A center of one side of the first planet carrier 1033 away from the first motor 1031 is provided with the sun gear 1037, and the sun gear 1037 and the first planet carrier 1033 are in an integral structure. The three first planetary gears 1034 are respectively mounted on the three first spindles 10331 and meshed with the inner gear ring 1032. The second planetary carrier 1035 may be rotatably mounted in the first reduction housing 1031 and is located at one end of the inner gear ring 1032 towards the first shaft 300, and the second planetary carrier 1035 is provided with a plurality of second spindles 10351 on one side facing the first planet carrier 1033, for example, three second spindles 10351. Three second planetary gears 1036 are respectively mounted on the three second spindles 10351 and meshed with the inner ring gear 1032 and the sun gear 1037 respectively. In some embodiments, an output shaft 1011 of the first motor 101 and the first shaft 300 are detachably connected with the first reduction assembly 103 respectively. For example, external teeth are arranged on the output shaft 1011 of the first motor 101. The output shaft 1011 stretches out from an output end of the first motor 101 and are meshed with the three first planetary gears 1034. A center of the second planetary carrier 1035 is provided with a through hole 10352, and a key groove is arranged on a side wall of the through hole 10352. One end of the first shaft 300 is provided with a spline, the end of the first shaft 300 provided with the spline enters the second planetary carrier 1035, and is fixed by a matching of the spline and key groove. When the output shaft 1011 of the first motor 101 rotates, the first planetary gear 1034 can be driven to rotate (spin) around the first spindle 10331 on the first planet carrier 1033, the first planetary gear 1034 is driven to rotate (revolve) around an axis of the first planet carrier 1033 simultaneously, and the first planetary gear 1034 is always meshed with the inner gear ring 1032 in a rotating process. The first planet gear 1034 revolutionizes and drives the first planet carrier 1033 and the sun gear 1037 to rotate so as to drive the second planetary gear 1036 to rotate around the second spindle 10351 on the second planetary carrier 1035. At the same time, the second planetary carrier 1035 rotates around its axis, and the second planetary carrier 1035 drives the first shaft 300 to rotate. In some embodiments, there is also a bottom plate 1038 on one side of the inner gear ring 1032 towards the first motor 101, which is used for supporting the first planetary gear 1034. The bottom plate 1038 is provided with a plurality of protruding flanges at intervals along its circumferential direction, the bottom plate 1038 is clamped on the first reduction housing 1031 through the protruding flange, and the output shaft of the first motor 101 passes through the bottom plate 1038 and is meshed with the first planet gear 1034.

Please refer to FIG. 1, FIG. 2, FIG. 3 and FIG. 10. In an embodiment, the impeller assembly 400 further includes an impeller housing 402 arranged at an outside of the impeller 401. A first end of the impeller housing 402 is connected with the main body 100, and a second end of the impeller housing 402 is communicated with the auger assembly 500. The impeller housing 402 is provided with an impeller cavity 4021, a first end of the first shaft 300 is connected with the first reduction assembly 103, and a second end of the first shaft 300 extends into the impeller cavity 4021. The impeller 401 is fixed on the first shaft 300 in a shape of a fan blade, and the accumulated snow swept in by the auger assembly 500 enters the impeller cavity 4021, and is thrown from a snow throwing port arranged above the impeller housing 402 with a rotation of the impeller 401.

Please refer to FIG. 1, FIG. 3, FIG. 10, FIG. 15 and FIG. 16. In an embodiment, the auger assembly 500 is arranged at a front end of a working plane of the snow thrower, and it includes an auger assembly 503. The auger assembly 503 includes an arc surface and two side surfaces, the arc surface and the two side surfaces form an auger cavity 5031, which is used for accommodating the auger 501 and the accumulated snow collected by the auger. The auger cavity 5031 is communicated with the impeller cavity 4021. Two ends of the second shaft 502 are rotatably mounted on both sides of the auger assembly 503 respectively. In some embodiments, the second shaft 502 is arranged perpendicular to the first shaft 300, and the auger 501 is mounted on the second shaft 502 in a spiral shape. The first shaft 300 drives the second shaft 502 to rotate through the second reduction assembly 301, and the auger 501 rotates synchronously with the second shaft 502, so as to collect the accumulated snow on the ground and enable the accumulated snow to enter the impeller cavity 4021, and the accumulated snow is thrown out from the snow throwing port arranged above the impeller housing 402 with the rotation of the impeller 401. The auger 501 of the embodiment rotates unidirectionally to a front of the snow thrower (along a forward direction of the snow thrower). In some embodiments, a distance L1 between an axis of the second shaft 502 (axis of rotation) and the ground is between 100 mm and 350 mm, and a diameter D1 of the auger 501 (which means that a diameter of an arc surface swept by the rotation of the auger around the axis of the second shaft) is between 150 mm and 550 mm. A diameter D2 of the impeller 401 (which means that a diameter of an arc surface swept by the impeller around the axis of the first shaft) is between 150 mm and 550 mm. An output power of the first motor 101 is from 2000 W to 10000 W, and a rotating speed of the first motor 101 is from 3000 rpm to 18000 rpm. In some embodiments, the rotating speed of the first motor 101 is from 5000 rpm to 15000 rpm. The rotating speed of the first shaft 300 and the impeller 401 transmitted from the first motor 101 by the first reduction assembly 103 is from 500 rpm to 1500 rpm, and the rotating speed of the second shaft 502 and the auger 501 transmitted from the first motor 101 by the second reduction assembly 301 is from 50 rpm to 150 rpm.

Figure 11:
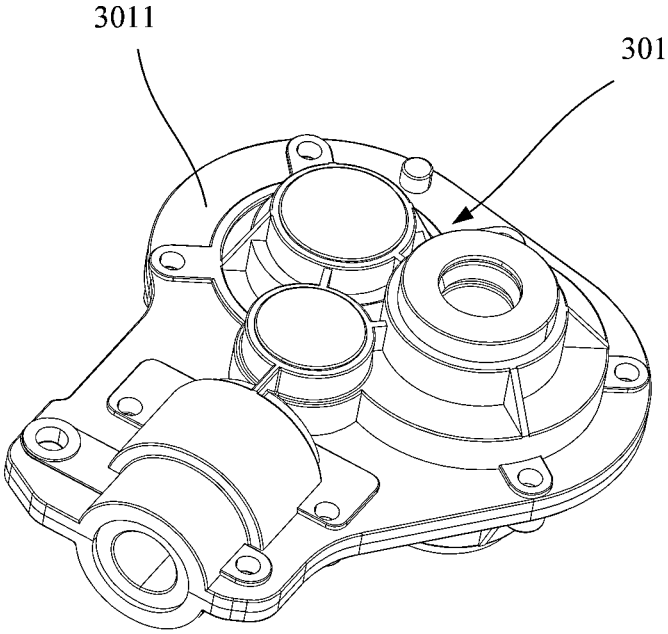
FIG. 11 is a schematic structural view of a second reduction assembly of the snow thrower according to at least one embodiment of the disclosure.
Figure 12:
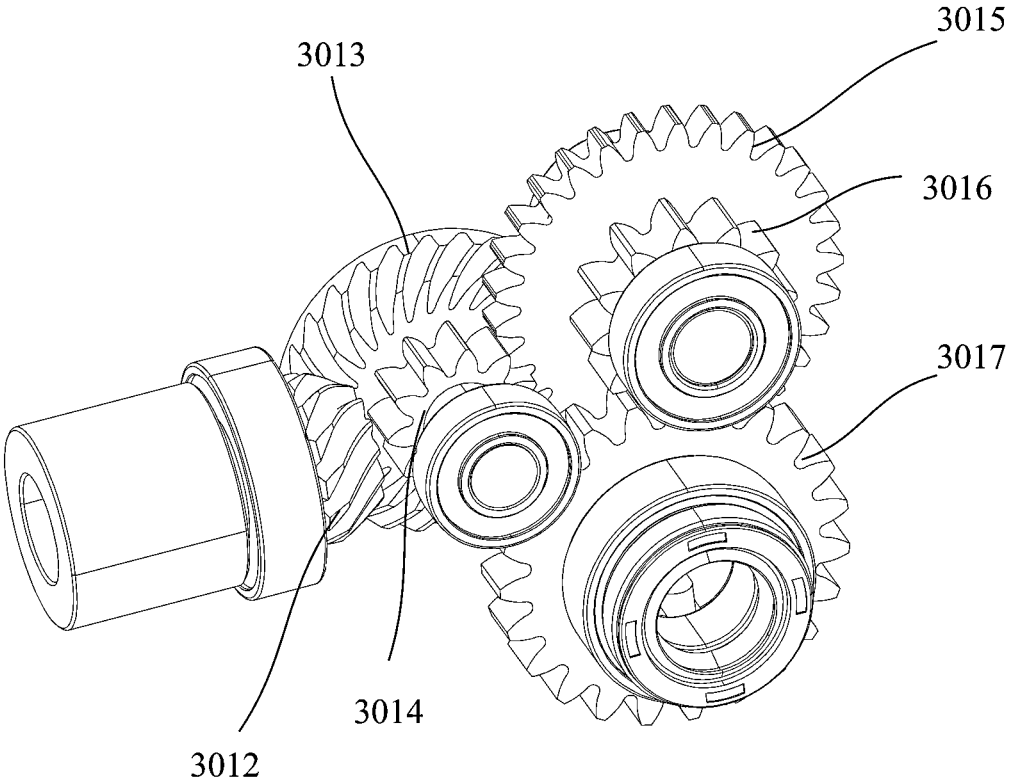
FIG. 12 is a schematic structural view of FIG. 11 after removing a reduction housing.
Figure 13:
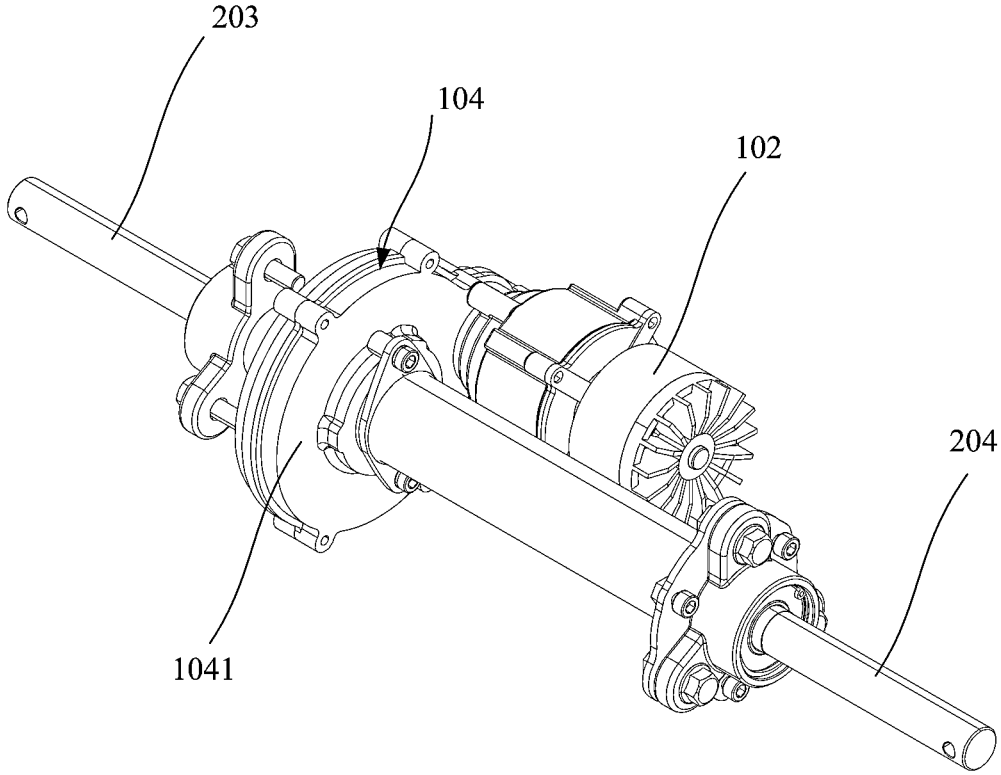
FIG. 13 is a schematic structural view of a second motor, a walking mechanism and a third reduction assembly of the snow thrower according to at least one embodiment of the disclosure.
Figure 14:
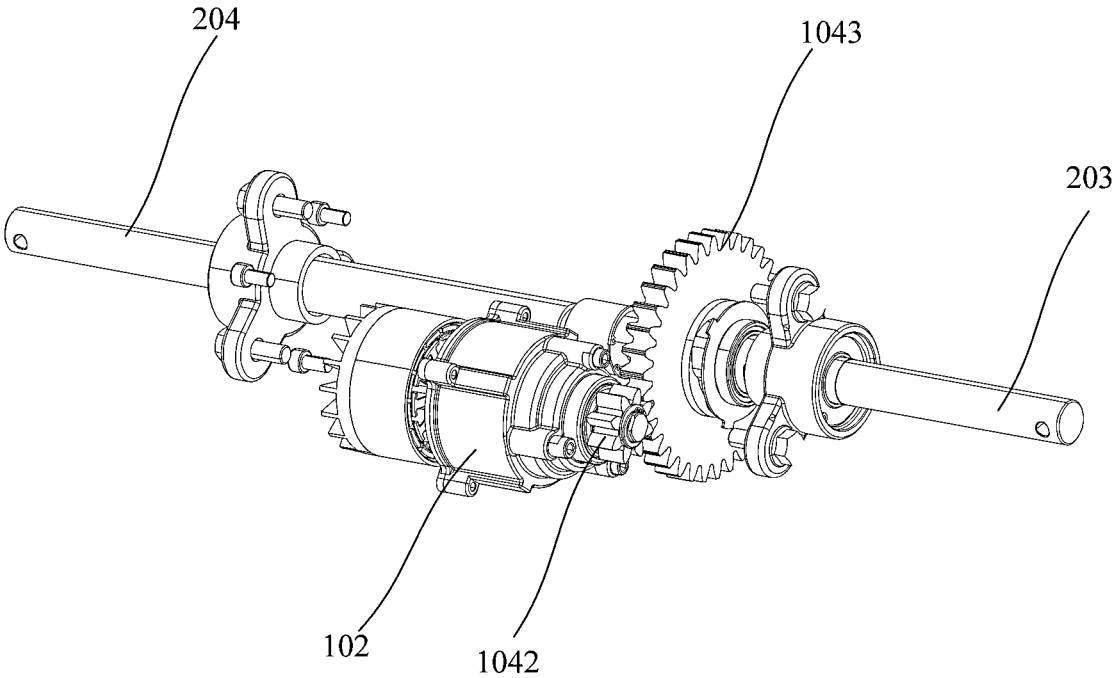
FIG. 14 is a schematic view of a third reduction assembly of a snow thrower after removing a reduction housing according to at least one embodiment of the disclosure.
Figure 15:
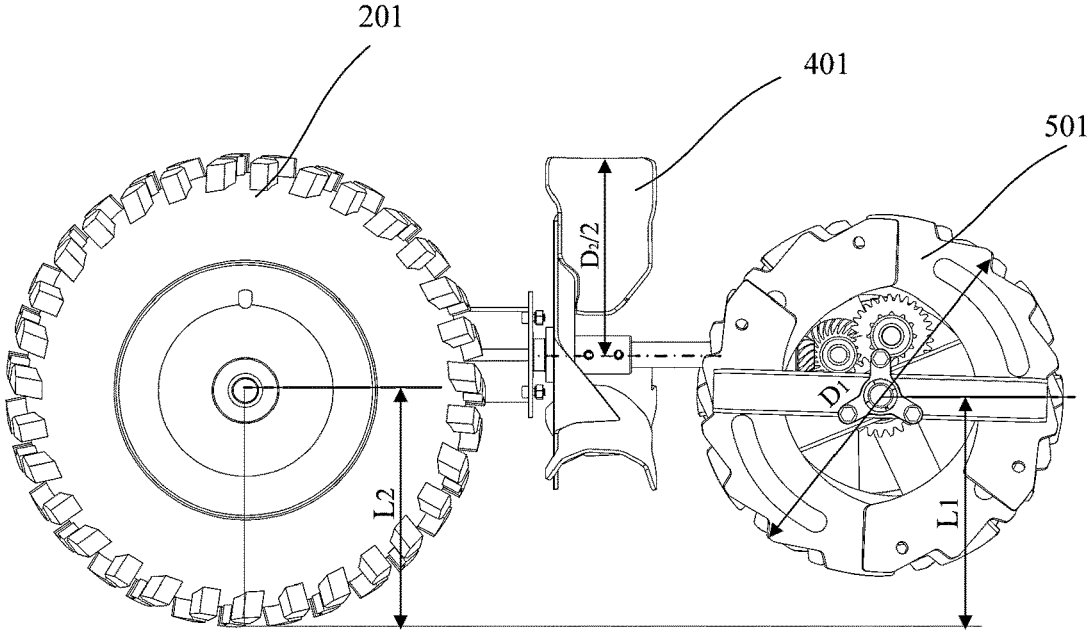
FIG. 15 is a side view of a snow thrower after removing a main body according to at least one embodiment of the disclosure.
Figure 16:
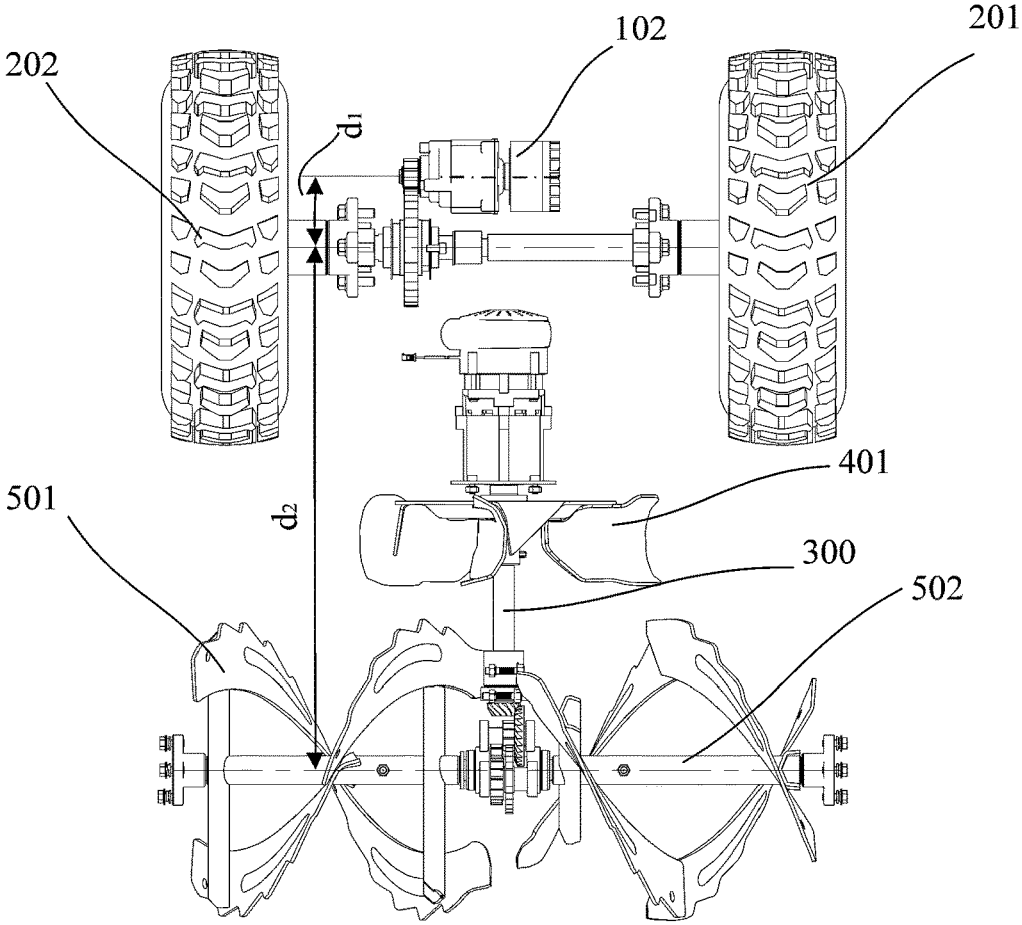
FIG. 16 is a top view of a snow thrower after removing a main body according to at least one embodiment of the disclosure.
Figure 17:
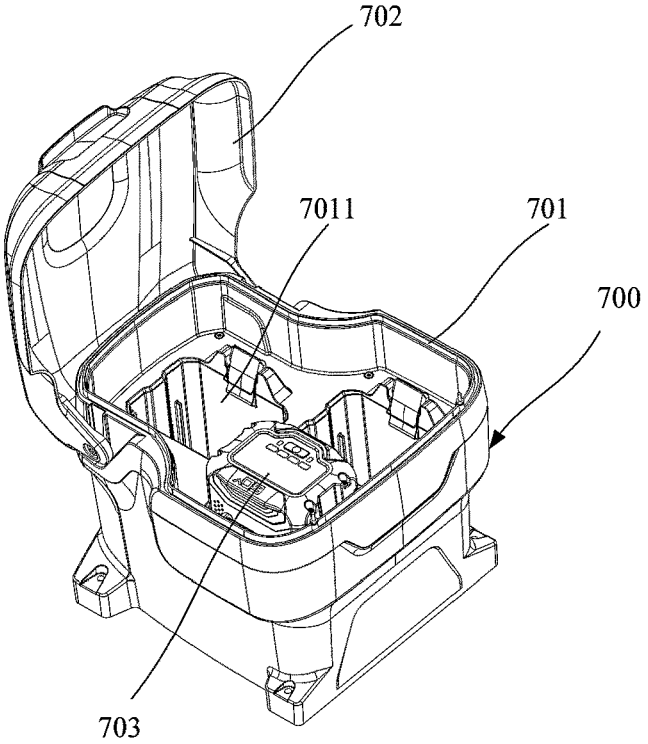
FIG. 17 is a schematic structural view of a battery assembly of a snow thrower according to at least one embodiment of the disclosure.

Please refer to FIG. 4, FIG. 11 and FIG. 12. A transmission stage of the second reduction assembly 301 is from 1 to 4, which means that the second reduction assembly 301 may be the first-stage transmission, the second-stage transmission, the third-stage transmission or the fourth-stage transmission. Of course, the second reduction assembly may also be with more transmission stages, which is not limited here. Considering the overall structure of the snow thrower and the transmission efficiency, the transmission stage of the second reduction assembly 301 is 3. In an embodiment, the second reduction assembly 301 includes a second reduction housing 3011 and transmission gears meshed with each other and arranged in the second reduction housing 3011. The transmission gear includes a bevel gear and a cylindrical gear, and the bevel gear includes a first bevel gear 3012 and a second bevel gear 3013 for example. The cylindrical gear includes for example a first gear 3014, a second gear 3015, a third gear 3016 and a fourth gear 3017. The second bevel gear 3013 and the first gear 3014 are arranged coaxially, the second gear 3015 and the third gear 3016 are arranged coaxially, the first bevel gear 3012 is meshed with the second bevel gear 3013, the first gear 3014 is meshed with the second gear 3015, and the third gear 3016 is meshed with the fourth gear 3017. In this embodiment, the second bevel gear 3013, the first gear 3014 are set up as double gears, and the second gear 3015 and the third gear 3016 are also set up as double gears. The first shaft 300 is detachably connected with the bevel gear 3012, for example, an end part of the first shaft 300 is provided with a spline, and a center of the bevel gear 3012 is provided with a key groove. A synchronous rotation of the first shaft 300 and the bevel gear 3012 is realized through a cooperation of the spline and the key groove. The second shaft 502 passes through an axle center of the fourth gear 3017 and is detachably connected with it, and its connection mode may also select a cooperation mode of the spline and the key groove, or other modes that may enable them to rotate synchronously. In other embodiments, the first shaft may also be detachably connected with the fourth gear, the first bevel gear is detachably connected with the second shaft, and the number and an arrangement mode of cylindrical gears may also be selected according to specific transmission needs. In this embodiment, transmission gears of the second reduction assembly 301 are arranged in a triangular pattern, which saves space and enables the structure of snow thrower to be more compact.

Figure 10:
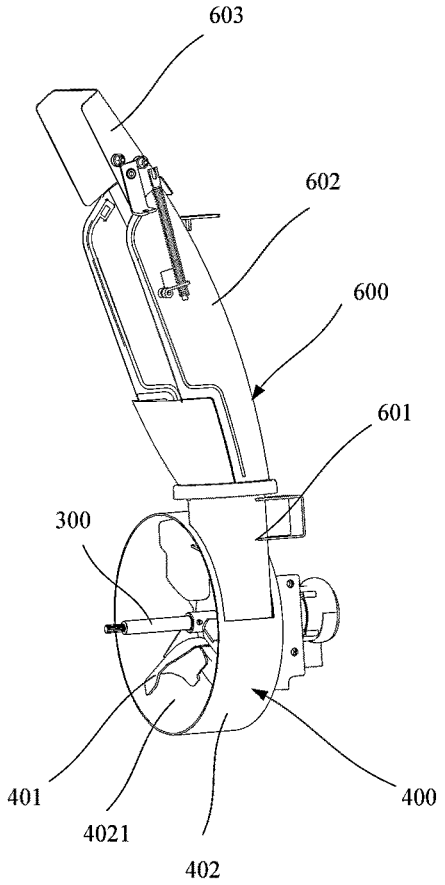
FIG. 10 is a schematic structural view of an impeller assembly and a chute assembly of the snow thrower according to at least one embodiment of the disclosure.

Please refer to FIG. 10. In an embodiment, the impeller housing 402 is further provided with a chute assembly 600, the chute assembly 600 includes a base 601, a chute assembly 602 and a snow pressing plate 603. The base 601 is fixedly connected with a snow outlet of the impeller housing 402 and is communicated with the impeller cavity 4021. The chute assembly 602 may be rotably connected with the base 601, a first side of the chute assembly 602 is provided with an opening, a second side of the chute assembly 602 is provided with the snow pressing plate 603, and the snow pressing plate 603 is used for adjusting an angle of snow throwing. In some embodiments, the chute assembly 600 further includes an adjustment structure of the chute assembly 602 (not shown in the figure). Under an effect of the adjustment structure, the chute assembly 602 may rotate within a certain angle range, so that it may throw snow to a left side, a left front side, a front side, a right front side and a right side. In this embodiment, the chute assembly 602 may rotate around a vertical axis, and a total angle range of the rotation is greater than or equal to 160° and less than or equal to 230°. Further, in some embodiments, the total angle range of the rotation of the chute assembly 602 is greater than or equal to 180° and less than or equal to 210°.

Please refer to FIG. 1, FIG. 2, FIG. 13 through FIG. 15. In an embodiment, the walking mechanism 200 includes a first walking wheel 201 and a second walking wheel 202 arranged on two sides of the main body 100. The driving module further includes a second motor 102, and the first walking wheel 201 and the second walking wheel 202 are driven by the second motor 102 arranged in the main body 100. A ratio of a rated output power of the second motor 102 to a rated output power of the first motor 101 is from 0.02 to 0.5. The output power of the second motor 102 is from 300 W to 2000 W, and its rotating speed is from 3000 rpm to 18000 rpm. In some embodiments, the rotating speed of the second motor 102 is from 3000 rpm to 15000 rpm. In an embodiment, the first walking wheel 201 and the second walking wheel 202 are respectively mounted on two ends of a wheel shaft. An output shaft of the second motor 102 is arranged in parallel with the wheel shaft, and a distance d1 between the two is kept at from 40 mm to 120 mm. In this embodiment, the distance d1 between the two is kept at from 50 mm to 100 mm in this embodiment. The second motor 102 drives the wheel shaft to rotate through the third reduction assembly 104, and then drives the first travel wheel 201 and the second travel wheel 202 to move. A transmission ratio between the second motor 102 and the wheel shaft is from 50 to 300.

Please refer to FIG. 1, FIG. 2, FIG. 13 through FIG. 16. The third reduction assembly 104 may include a planetary gear transmission or may a transmission for a cylindrical gear combination of a multi-stage parallel shaft. For example, the third reduction assembly 104 includes a third reduction housing 1041, a gear A 1042 and a gear B 1043 arranged in the third reduction housing 1041. The gear A 1042 is mounted on an output shaft of the second motor 102, and the gear B 1043 is meshed with the gear A 1042. The wheel shaft between the first walking wheel 201 and the second walking wheel 202 is mounted on gear B 1043. Wherein, a distance of a rotation center of the first walking wheel 201 to the ground and a distance of the rotating center of the second traveling wheel 202 to the ground (which means a supporting plane of the walking mechanism 200) both are from 100 mm to 350 mm, for example, from 100 mm to 300 mm. In this embodiment, it means that a distance L2 from the wheel shaft to the ground is from 100 mm to 350 mm, and under an effect of the third reduction assembly 104, a rotating speed of the wheel shaft is from 20 rpm to 120 rpm. In some embodiments, the wheel shaft adopts a separating type shaft, which includes a first wheel shaft 203 and a second wheel shaft 204 that are coaxially arranged. The first wheel shaft 203 is used for mounting the first walking wheel 201, the second wheel shaft 204 is used for mounting the second walking wheel 202, and a clutch device may be arranged at a connection of the first wheel shaft 201 and the second wheel shaft 202, so that the two wheel shafts are convenient for working in a differential speed in a same direction or in a reverse direction. In this embodiment, a center distance d2 between the wheel shaft of the walking mechanism 200 and the second shaft 502 is greater than or equal to 280 mm and less than or equal to 850 mm, which means that a center distance between the first wheel shaft 203 and the second shaft 502, and a center distance between the second wheel shaft 204 and the second shaft 502 are greater than or equal to 280 mm and less than or equal to 850 mm.

Please refer to FIG. 1, FIG. 2, FIG. 3 and FIG. 17. In an embodiment, the snow thrower further includes a battery assembly 700, which is used to supply power for the first motor 101 and the second motor 102. The battery assembly 700 is mounted above the main body 100. The battery assembly 700 includes a battery body 701, a battery cover 702 and a plurality of battery packs 703 mounted inside the battery body 701. The battery body 701 is provided with a plurality of battery pack cavities 7011, for example, three. The plurality of battery packs 703 is respectively mounted in the plurality of battery pack cavities 7011, the battery cover 702 may be rotatably mounted on the battery body 701, and is used for covering the battery pack 703. When the battery pack 703 needs to be replaced, the battery cover 702 may be opened, which is convenient and quick. The battery pack 703 is electrically connected with a PCB circuit board (not shown in the figure). The first motor 101 and the second motor 102 are electrically connected with the PCB circuit board respectively, and the battery assembly 700 supplies power to the first motor 101 and the second motor 102 through the PCB circuit board.

In some embodiments, a bottom of the main body 100 corresponding to an air outlet cover 1012 of the first motor 101 is further provided with an air outlet hole, so that heat inside the main body 100 may be diffused to an outside of the main body. A rear side of main body 100 is provided with a handle 8, which is convenient for a pushing and pulling of snow thrower.

Please refer to FIG. 18 through FIG. 25. The embodiment provides the snow thrower. The snow thrower includes the main body, the walking mechanism 200, a driving module 20, a control module 30 and a snow remove assembly 40. It may be understood that, in a specific embodiment of the disclosure, for different driving types, the disclosure should contain a necessary energy source, which may be, for example, a battery or an internal combustion engine.

Figure 18:
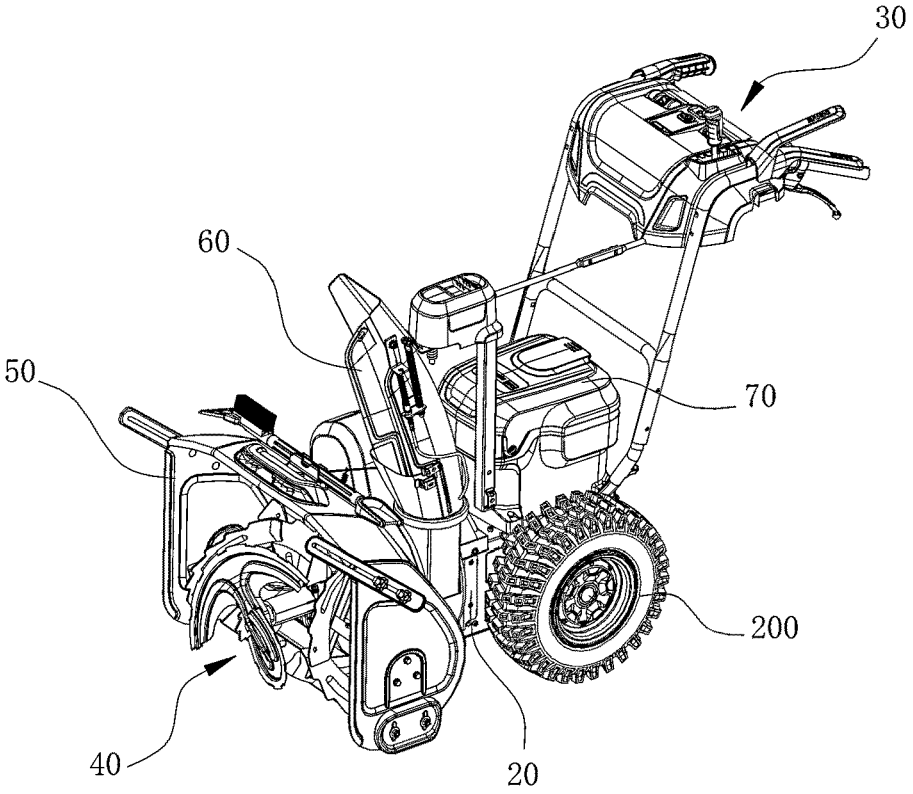
FIG. 18 is a perspective schematic structural view of the snow thrower according to at least one embodiment of the disclosure.
Figure 19:
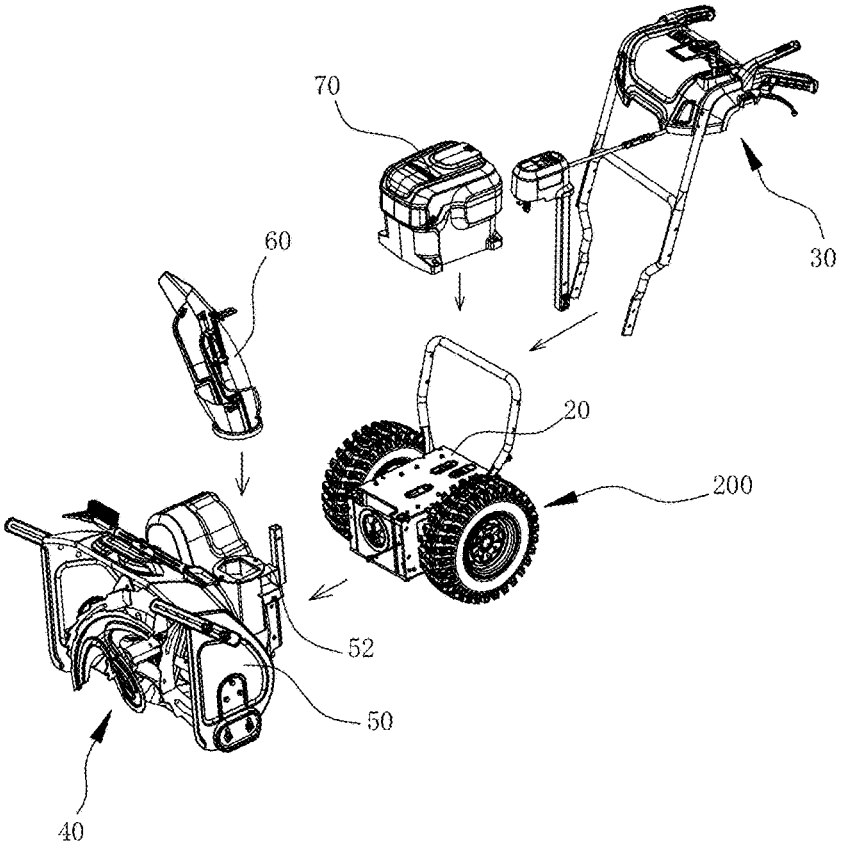
FIG. 19 is an exploded view of a snow thrower according to at least one embodiment of the disclosure.
Figure 20:
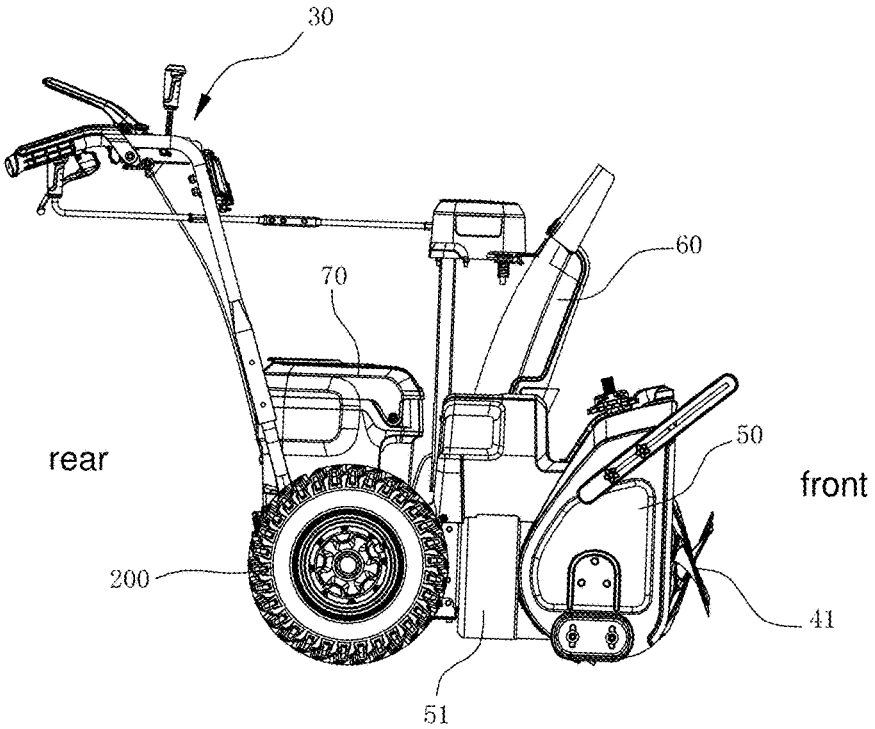
FIG. 20 is a side view of a snow thrower according to at least one embodiment of the disclosure.

Please refer to FIG. 18 through FIG. 20, it may be understood that, the walking mechanism 200 generally includes a wheel, and the driving module may, for example, be a combination of the motor and the reducer, or the driving module may also be the separate motor. In an embodiment of the disclosure, the main body is provided with an armrest, the walking mechanism 200 includes two wheels, and the two wheels are in a transmission connection with an output shaft of the reducer, or directly in the transmission connection with a main shaft of the motor. It should be noted that the main body of the disclosure is not limited to the illustrated embodiments, for example, the disclosure may also be applied to a seat-type snow thrower, a standing snow thrower or an unmanned snow thrower, etc.

Please refer to FIG. 18 and FIG. 19. The driving module 20 is mounted on the main body, and the driving module 20 may drive the snow remove assembly 40 to work. It may be understood that the snow remove assembly 40 may share the same driving module 20 with the walking mechanism 200, or adopt an independent driving component to drive the snow remove assembly 40 to work. For example, a part of power of the wheel is transmitted to the snow remove assembly 40 through a transfer case or is provided with an independent motor to drive the snow remove assembly 40.

Please refer to FIG. 18 through FIG. 20. The control module 30 is at least connected with the driving module 20 and is used for controlling a power distribution of the driving module 20, and then controlling operations such as the moving of the snow thrower, an on-off of the snow remove assembly 40.

Please refer to FIG. 21 through FIG. 25. The snow remove assembly 40 is mounted at a front end of the main body. The snow remove assembly 40 includes the first shaft 300, the second shaft 502, the transmission part, the snow breaking blade 41, the auger 501 and the impeller 401. An upper side and a rear side of the snow remove assembly 40 are provided with a cover 50. The cover 50 is fixedly connected with the walking mechanism 200, and the snow breaking blade 41 is arranged and protrudes from a front side of the cover 50.

Figure 22:
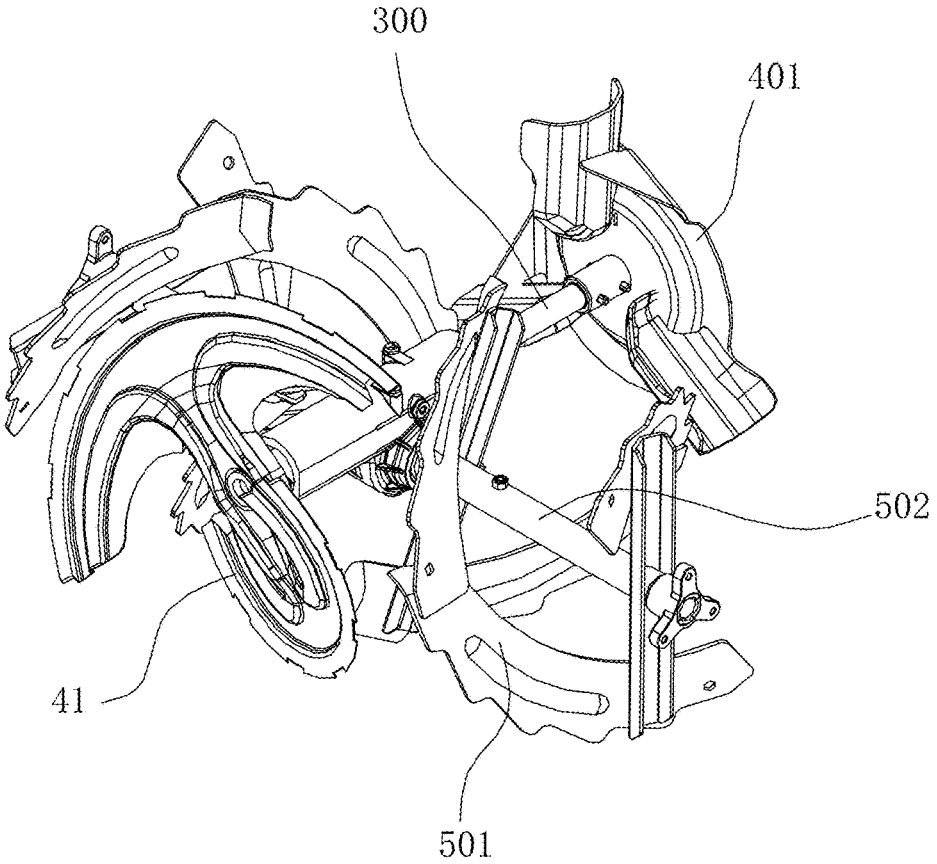
FIG. 22 is a perspective schematic structural view of a snow remove assembly according to at least one embodiment of the disclosure.
Figure 23:
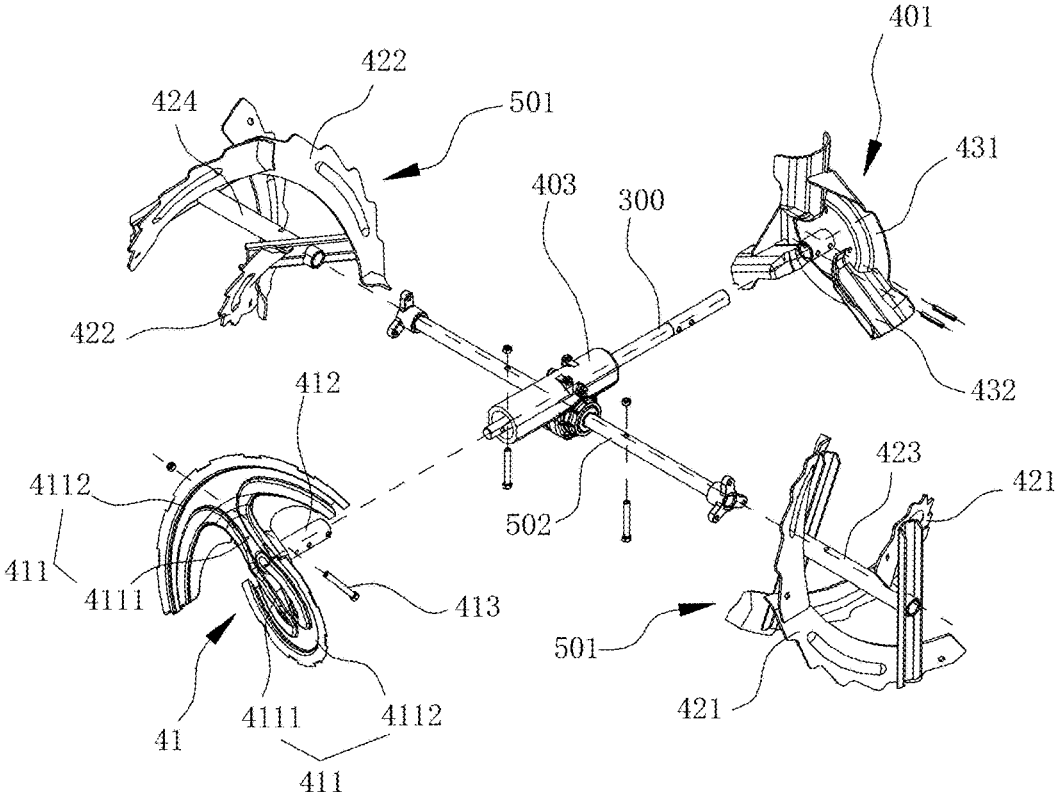
FIG. 23 is an exploded view of the snow remove assembly of a snow thrower according to at least one embodiment of the disclosure.

Please refer to FIG. 22 and FIG. 23. The first shaft 300 is arranged along a horizontal first direction, and the first shaft 300 is in the transmission connection with the driving module 20. The second shaft 502 is arranged along a horizontal second direction, and the second direction is perpendicular to the first direction. The transmission part is arranged between the first shaft 300 and the second shaft 502 so that the first shaft 300 and the second shaft 502 are in the transmission connection. It may be understood that the first direction is a direction in which the snow thrower moves forwards or backwards, and the second direction is a width direction of the snow thrower. The first shaft 300 of the disclosure is in the transmission connection with the driving module 20. For example, the first shaft 300 is rotably connected with the driving module 20 through the belt or the gear, and the first shaft 300 transmits power to the second shaft 502 through the transmission part, so that one driving source may drive the two shafts to rotate simultaneously, and a device structure is simplified.

Please refer to FIG. 18 through FIG. 24. The snow breaking blade 41 is fixedly arranged at a front end of the first shaft 300. In an embodiment of the disclosure, the snow breaking blade 41 includes a blade board 411, the blade board 411 is arranged along a radial extending direction of the first shaft 300. The blade board 411 includes a connection part 4111 and an auger part 4112, the connection part 4111 is fixedly connected with the first shaft 300, and the connection part 4111 is arranged along the radial extending direction of the first shaft 300. The blade 4112 is located at an overhanging end of the connection part 4111. The auger part 4112 is arc-shaped, and the auger part 4112 is arranged in a spiral along an axis direction of the first shaft 300, so that when the first shaft 300 rotates, the auger part 411 can push the accumulated snow in contact with the auger part 411 to a rear end of the first shaft 300. A sleeve barrel 412 is connected on the snow breaking blade 41, the sleeve barrel 412 is plug-in fitted with the front end of the first shaft 300, the sleeve barrel 412 and the first shaft 300 are provided with corresponding pin holes, and a safety pin 413 is inserted in the pin holes, so as to realize a relative fixation of sleeve barrel 412 and first shaft 300. There are at least two blade boards 411, a center of each blade board 411 is arranged at intervals along a circumferential direction of the first shaft 300, and an extending distance of each of at least two of the blade boards 411 in radial direction of the first shaft 300 is different, so that end parts of different blade boards 411 can be distributed in different radial positions, and the accumulated snow may be crushed and cut at multiple levels. It may be understood that, the snow breaking blade 41 is arranged into a twisted spiral structure, and can plane compacted snow apart in a rotation process of the first shaft 300, and the twisted shape can convey the crushed snow to the cover 50 simultaneously, which avoids a snow accumulation in front of snow thrower, and guarantee that the snow breaking blade 41 can smoothly move forward. The embodiment is provided with two blade boards 411, a larger one and a smaller one. The larger blade board 411 can cut the compacted snow into larger snow blocks, and the smaller blade board 411 can further break the snow blocks, so as to facilitate a subsequent collection and throwing. It should be noted that, the snow breaking blade 41 of the disclosure is not limited to the above-mentioned shape, for example, the snow breaking blade 41 may also be a sickle shape.

Please refer to FIG. 18 through FIG. 24. The auger 501 is fixedly arranged on the second shaft 502 and is distributed on two sides of the first shaft 300. In an embodiment of the disclosure, the auger 501 includes first spiral blades 421 and second spiral blades 422. The first spiral blades 421 and the second spiral blades 422 are configured such that when the second shaft 502 rotates, the first spiral blades 421 and the second spiral blades 422 can gather the snow to an intersection area of the second shaft 502 and the first shaft 300. In an embodiment, rotation directions of the first spiral blades 421 and the second spiral blades 422 are opposite, and the first spiral blades 421 and the second spiral blades 422 are symmetrically arranged on both sides of the first shaft 300. There are at least two first spiral blades 421 and at least two the second spiral blades 422 respectively. Each first spiral blade 421 is arranged at intervals along the circumferential direction of the second shaft 502, and each second spiral blade 422 is arranged at intervals along the circumferential direction of the second shaft 502. In an embodiment, each first spiral blade 421 is mounted on the first sleeving tube 423, and the first sleeving tube 423 is detachably connected with the second shaft 502. A radial bracket is arranged on the first sleeving tube 423, and each first spiral blade 421 is fixedly connected with the radial bracket, so that each first spiral blade 421 forms an integral assembly to facilitate an assembly and disassembly of the first spiral blade 421. It is foreseeable that each of the second spiral blades 422 is integrated on the second sleeving tube 424 in a same way. It may be understood that, when the second shaft 502 rotates, since the rotation directions of the first spiral blades 421 and the second spiral blades 422 are opposite, the accumulated snow can be gathered towards a center of the second shaft 502, so that the accumulated snow can be smoothly guided to the impeller 401.

Please refer to FIG. 22 and FIG. 23. The impeller 401 is fixedly arranged at a rear end of the first shaft 300. In an embodiment, the impeller 401 includes an impeller base 431 and an impeller blade 432. The impeller base 431 is fixedly connected with the first shaft 300, and there are at least two impeller blades 432. Each impeller blade 432 is arranged at intervals along a circumferential direction of the impeller base 431. It may be understood that, the accumulated snow on the impeller blade 432 can produce a strong centrifugal force during a high-speed rotation of the impeller base 431, so that the accumulated snow is thrown outward along a radial direction of the impeller base 431.

Figure 21:
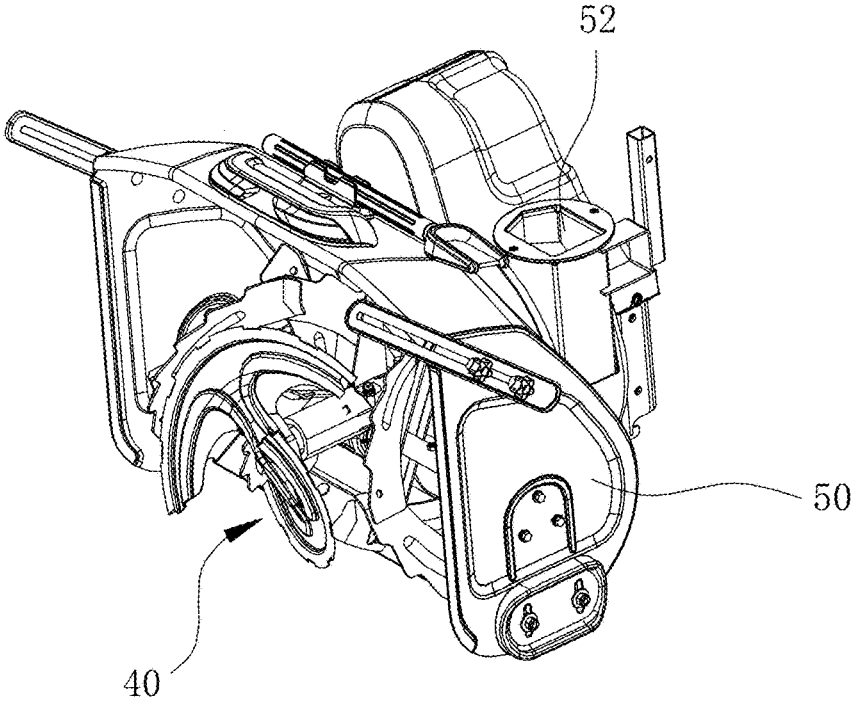
FIG. 21 is a schematic structural view of an assembly of a snow remove assembly and a cover of a snow thrower according to at least one embodiment of the disclosure.
Figure 25:
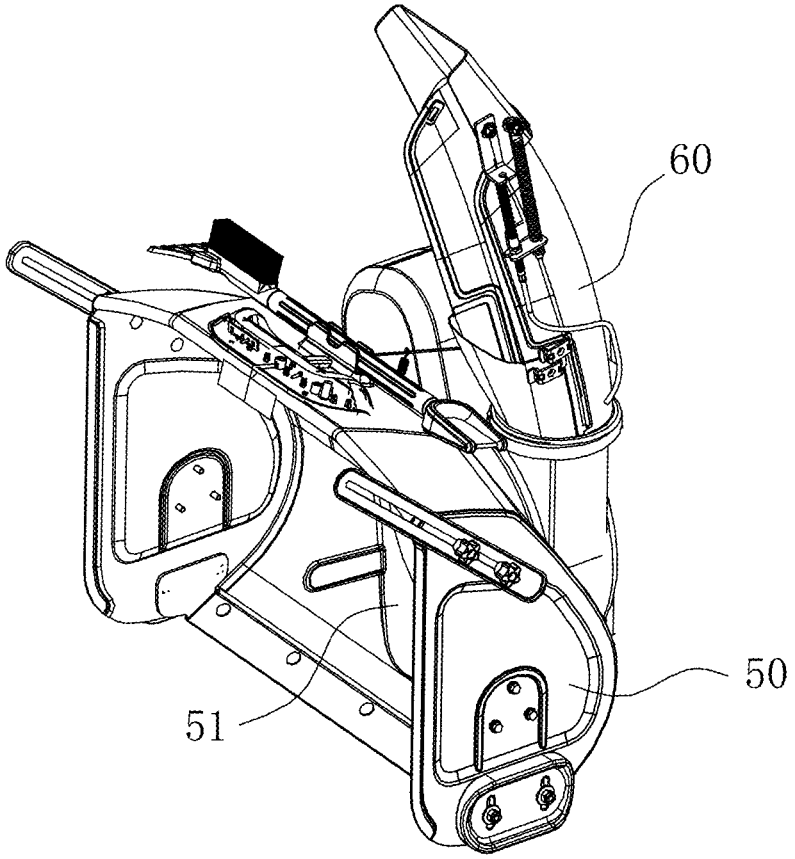
FIG. 25 is a perspective schematic structural view of a cover of a snow thrower according to at least one embodiment of the disclosure.

Please refer to FIG. 21 and FIG. 25. An impeller cavity 51 is arranged at a rear end of the cover 50. The impeller 401 is located in the impeller cavity 51, and a snow throwing port 52 is arranged on a side wall of the impeller cavity 51. An outside of the snow throwing port 52 is connected with a snow throwing chute 60, and the snow throwing chute 60 is rotably connected with the snow throwing port 52 to adjust a snow throwing angle.

Figure 24:
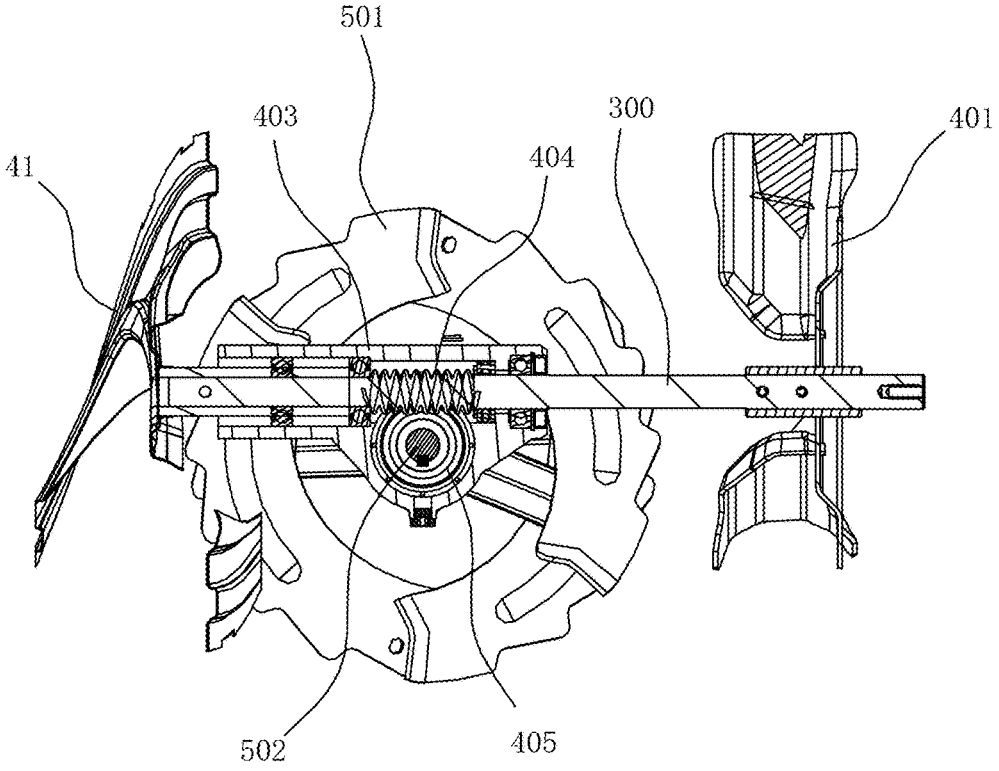
FIG. 24 is a cross-sectional view of a snow remove assembly of a snow thrower according to at least one embodiment of the disclosure.

Please refer to FIG. 24. In an embodiment, the transmission part includes a worm 404 and a worm gear 405. The worm 404 is fixedly arranged relative to the first shaft 300.

For example, the worm 404 may be processed into an integral structure with the first shaft 300. Or the first shaft 300 and the worm 404 are respectively processed, and then the two are assembled with interference. The worm gear 405 is fixedly connected with the second shaft 502, and the worm 404 is meshed with the worm gear 405. The worm gear 405 and the worm 404 are provided with a housing 403 thereoutside, and the first shaft 300 and the second shaft 502 are rotably connected with the housing 403. The worm gear mechanism can not only realize the power transmission in the vertical direction, but also has an effect of reducer in itself. It may be understood that, the rotating speeds of the snow breaking blade 41 and impeller 401 during working need to be higher than the rotating speed of the auger 501 during working, and the worm gear 405 and worm 404 of the disclosure realize a reduction transmission of the first shaft 300 to the second shaft 502.

In summary, the snow thrower of the disclosure utilizes the first reduction device to transmit the power of the first motor to the first shaft, and the first shaft transmits the power of the first motor to the auger assembly through the second reduction device. The accumulated snow is rolled into the auger assembly by the rotation of the auger, and the accumulated snow is thrown out of the impeller cavity along with the rotation of the impeller. The planetary gear reducer device is adopted so that the structure is exquisite, and the transmission efficiency is high, which enables the structure of the snow thrower of the disclosure to be more compact, and enables the snow throwing efficiency to be higher. Therefore, the disclosure effectively overcomes some practical problems in the prior art, thereby having high utilization value and use significance.

The snow breaking blade 41 is arranged into a twisted anchor-like structure, and can plane compacted snow apart in the rotation process of the first shaft 300, and the twisted shape can convey the crushed snow to the cover 50 simultaneously, which avoids the snow accumulation in front of snow thrower, and guarantees that the snow breaking blade 41 can smoothly move forward. The disclosure is provided with two blade board 411, the larger one and the smaller one. The larger blade board 411 can cut the compacted snow into larger snow blocks, and the smaller blade board 411 can further break the snow blocks, so as to facilitate the subsequent collection and throwing. When the second shaft 502 rotates, since the rotation directions of the first spiral blades 421 and the second spiral blades 422 are opposite, the accumulated snow can be gathered towards the center of the second shaft 502, so that the accumulated snow can be smoothly guided to the impeller 401. The worm gear 405 and the worm 404 can not only realize the power transmission in the vertical direction, but also have the effect of reducer in itself. The rotating speeds of the snow breaking blade 41 and impeller 401 during working needs to be higher than the rotating speed of the auger 501 during working, and the worm gear 405 and worm 404 of the disclosure realize the reduction transmission of the first shaft 300 to the second shaft 502.

The above embodiments only illustrate principles and effects of the disclosure, but are not intended to limit the disclosure. Anyone familiar with this technology may modify or change the above embodiments without departing from a scope of the disclosure. Therefore, all equivalent modifications or changes made by those with ordinary knowledge in the technical field without departing from the technical ideas disclosed in the disclosure shall still be covered by the claims of the disclosure.

What is claimed is:

1. A snow thrower, comprising:

a main body;

a walking mechanism, connected with the main body and driving the snow thrower;

a snow remove assembly, mounted on a front end of the main body and comprising:

a first shaft, an axis of the first shaft being arranged along a first direction, a second shaft, an axis of the second shaft being arranged along a second direction, and the second direction being perpendicular to the first direction or arranged at an angle with the first direction, a transmission part, arranged between the first shaft and the second shaft to enable the first shaft to be connected with the second shaft for transmission, an impeller, mounted on the first shaft, an auger, mounted on the second shaft and distributed at two sides of the first shaft, and a snow breaking blade, mounted at a front end of the first shaft; and a driving module, connected to the first shaft and the walking mechanism for transmission, wherein the snow breaking blade comprises at least two blade boards protruding from the first shaft, protruding distances of the at least two blade boards along a radial direction of the first shaft are different, and end parts of the at least two blade boards are distributed in different radial positions, whereby accumulated snow is crushed and cut at multiple levels.

2. The snow thrower according to claim 1, wherein, the transmission part comprises a bevel gear and a cylindrical gear, and the bevel gear comprises a first bevel gear and a second bevel gear, the cylindrical gear comprises a first gear, a second gear, a third gear and a fourth gear, the first gear and the second bevel gear are coaxially arranged, the second gear and the third gear are coaxially arranged, the first bevel gear is meshed with the second bevel gear, the first gear is meshed with the second gear, the third gear is meshed with the fourth gear, the first shaft is detachably connected with the first bevel gear, and the second shaft is detachably connected with the fourth gear.

3. The snow thrower according to claim 1, wherein, the driving module includes a first motor, a first end of the first shaft is connected with the first motor through a first reduction assembly, the first reduction assembly comprises a planetary transmission device, and power of the first motor is transmitted to the first shaft through the first reduction assembly.

4. The snow thrower according to claim 3, wherein, the planetary transmission device comprises a first reduction housing, an inner gear ring, a first planet carrier, a first planetary gear, a second planet carrier, a second planetary gear and a sun gear, the inner gear ring is installed in the first reduction housing, the first planetary gear is mounted on the first planet carrier and meshes with the inner gear ring, the sun gear is arranged at a center of the first planet carrier, the second planetary gear is mounted on the second planetary carrier and meshes with the inner gear ring and the sun gear respectively, and the second planetary carrier is connected with the first shaft.

5. The snow thrower according to claim 4, wherein, an output shaft of the first motor is provided with external teeth, and an output end of the first motor is meshed with the first planetary gear.

6. The snow thrower according to claim 3, wherein, a transmission stage of the first reduction assembly is from 1 to 4, and a transmission stage of a second reduction assembly is from 1 to 4.

7. The snow thrower according to claim 3, wherein, the driving module further comprises a second motor to drive the walking mechanism, and a ratio of a rated output power of the second motor to a rated output power of the first motor is from 0.02 to 0.5.

8. The snow thrower according to claim 7, wherein, the walking mechanism comprises a wheel shaft and walking wheels arranged at two ends of the wheel shaft, the second motor drives the wheel shaft to rotate through a third reduction assembly;

an output shaft of the second motor and the wheel shaft are arranged in parallel, and a center distance between the output shaft of the second motor and the wheel shaft is greater than or equal to 40 mm and less than or equal to 120 mm.

9. The snow thrower according to claim 1, wherein, the walking mechanism comprises a walking wheel, and a distance from a rotation center of the walking wheel to a ground is from 100 mm to 350 mm.

10. The snow thrower according to claim 9, wherein, a distance from the rotation center of the walking wheel to the second shaft is greater than or equal to 280 mm and less than or equal to 850 mm.

11. The snow thrower according to claim 1, wherein, the at least two blade boards are connected with a sleeve barrel, the sleeve barrel is plug-in fitted with the front end of the first shaft, the sleeve barrel and the first shaft are provided with pin holes corresponding to each other, and the pin holes are provided with a safety pin.

12. The snow thrower according to claim 11, wherein, each blade board comprises a connection part and an auger part, the connection part is fixedly connected with the first shaft, the connection part is arranged cantilevered radially along the first shaft, the auger part is located at an overhanging end of the connection part, the auger part is arc-shaped, the auger part is arranged in a spiral shape along an axis direction of the first shaft, so as to enable each blade board to be capable of pushing snow in contact with each blade board to a rear of the first shaft when the first shaft rotates.

13. The snow thrower according to claim 11, wherein each blade board is arranged at intervals along a circumferential direction of the first shaft.

14. The snow thrower according to claim 1, wherein, an upper side and a rear side of the snow remove assembly are provided with a cover, the cover is fixedly connected with the main body, the snow breaking blade protrudes forward from a frontmost end of the cover, a rear end of the cover is provided with an impeller cavity, the impeller is located in the impeller cavity, a side wall of the impeller cavity is provided with a snow throwing port, an outside of the snow throwing port is connected with a snow throwing chute, and the snow throwing chute is rotatably connected with the snow throwing port to adjust a snow throwing angle.

* * * * *